US011485164B1

(12) United States Patent
Khaliq

(10) Patent No.: US 11,485,164 B1
(45) Date of Patent: Nov. 1, 2022

(54) FOLDABLE CLIPBOARD

(71) Applicant: Muhammad Sarfraz Khaliq, DongGuan (CN)

(72) Inventor: Muhammad Sarfraz Khaliq, DongGuan (CN)

( * ) Notice: Subject to any disclaimer, the term of this patent is extended or adjusted under 35 U.S.C. 154(b) by 0 days.

(21) Appl. No.: 17/402,775

(22) Filed: Aug. 16, 2021

(51) Int. Cl.
*B42F 9/00* (2006.01)

(52) U.S. Cl.
CPC ..... *B42F 9/001* (2013.01)

(58) Field of Classification Search
CPC ..... B42F 9/001
See application file for complete search history.

(56) References Cited

U.S. PATENT DOCUMENTS 6,213,439 B1 * 4/2001 Giulie ..... A47B 97/04 248/459
2006/0175520 A1 * 8/2006 Cooper ..... B60N 3/005 248/444
2007/0187565 A1 * 8/2007 Liptan ..... B42F 9/001 248/456
2010/0084848 A1 * 4/2010 Nguyen ..... B42F 9/001 24/67 R
2015/0096157 A1 * 4/2015 Paulick ..... B42F 9/002 24/67 R

* cited by examiner

*Primary Examiner* — Kyle R Grabowski
(74) *Attorney, Agent, or Firm* — Southern Plains IP Law PLLC; Sue C. Watson

(57) ABSTRACT

An improved foldable clipboard having a first extended orientation and a second folded orientation. The improved foldable clipboard includes a top folding portion having a first top hinge arm and bracket and a second top hinge arm and bracket. A bottom folding portion includes a first bottom hinge and a second bottom hinge. The first top and bottom hinge arms and the second top and bottom hinge arms, respectively, connect via connectors to provide first and second hinges, respectively. First and second hinges adjoin the top folding portion and the bottom folding portion to form a flat, planar structure and a folded structure. A clip is operatively coupled to a front surface of the top folding portion.

11 Claims, 5 Drawing Sheets

FOLDABLE CLIPBOARD

TECHNICAL FIELD OF THE INVENTION

The present invention relates to an improved foldable clipboard, and more particularly to a foldable clipboard formed of a top folding portion and a bottom folding portion, that are pivotally joined with first and second hinges.

BACKGROUND OF THE INVENTION

Clipboards are utilized in a variety of different environments where a portable writing surface may be required. To this end, conventionally known basic clipboards generally consist of a flat panel or board and a clip mounted to one end of the board. The clip retains the papers or other documents being written upon against the writing surface provided by the board. Clipboards have been an essential mobile writing platform that provides a flat surface for writing or drawing and which incorporate a clip device to secure a sheet of papers. Clipboards with varying sizes and shapes are available commercially. Existing clipboards are cumbersome to carry due to their relatively large size and are inconvenient, to operate. These clipboards have been restricted to merely carrying a few papers and sometimes cause tearing of papers. These problems cause difficulty for people who travel from one location to other, research scholars and the like.

While some of the foregoing is alleviated by conventional mechanical and more recently by computer-based electronic voting machines utilizing proven and applicable means of data entry such as special keyboards or touch-screens that have been constructed for conventional electronic voting machines, these do not allow or provide any way for personal checking of votes cast to increase the voter's confidence. While the use of computers for vote tabulation and record keeping for each voting machine and/or election can be done with almost zero error, voter confidence in the process is still a subject to be considered. A particular concern relates to the nature of records stored in electronic and magnetic form which are intangible and can be changed without leaving any evidence thereof.

SUMMARY OF THE INVENTION

According to an embodiment of the present invention, there is disclosed an improved foldable clipboard having a first extended orientation and a second folded orientation. The improved foldable clipboard includes a top folding portion having a first top hinge arm and bracket and a second top arm and bracket. A bottom folding portion includes a first bottom hinge arm and a second bottom hinge arm. The first top and bottom hinge arms and the second top and bottom hinge arms, respectively, connect via connectors to provide first and second hinges, respectively. First and second hinges adjoin the top folding portion and the bottom folding portion to form a flat, planar structure and a folded structure. A clip is operatively coupled to a front surface of the top folding portion.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
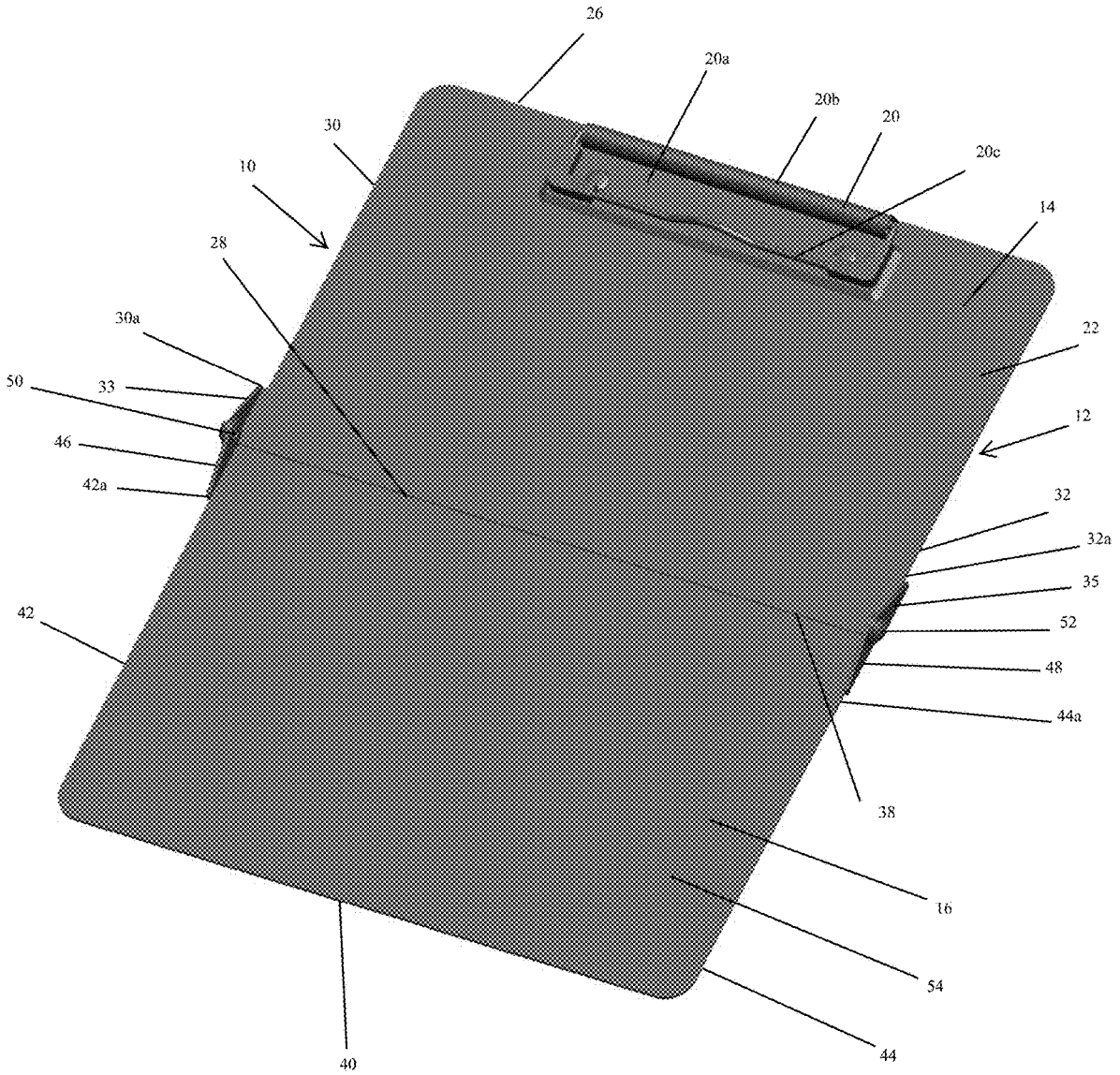
FIG. 1 is a front, three dimensional view of the improved foldable clipboard in an open position, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

The improved foldable clipboard 10 is designed as an improvement to a traditional flat and rigid clipboard. The foldable clipboard 10 is of particular use to doctors and medical students because the clipboard 10 can be folded to comfortably fit into a medical coat or scrubs. For example, the foldable clipboard 10 may be utilized to secure patient assessment forms, nursing protocols, medication lists, and all documentation in a HIPAA compliant secure folding clipboard. However, it is within the terms of the embodiment that the clipboard 10 be used to accommodate the needs of a variety of different people.

Figure 2:
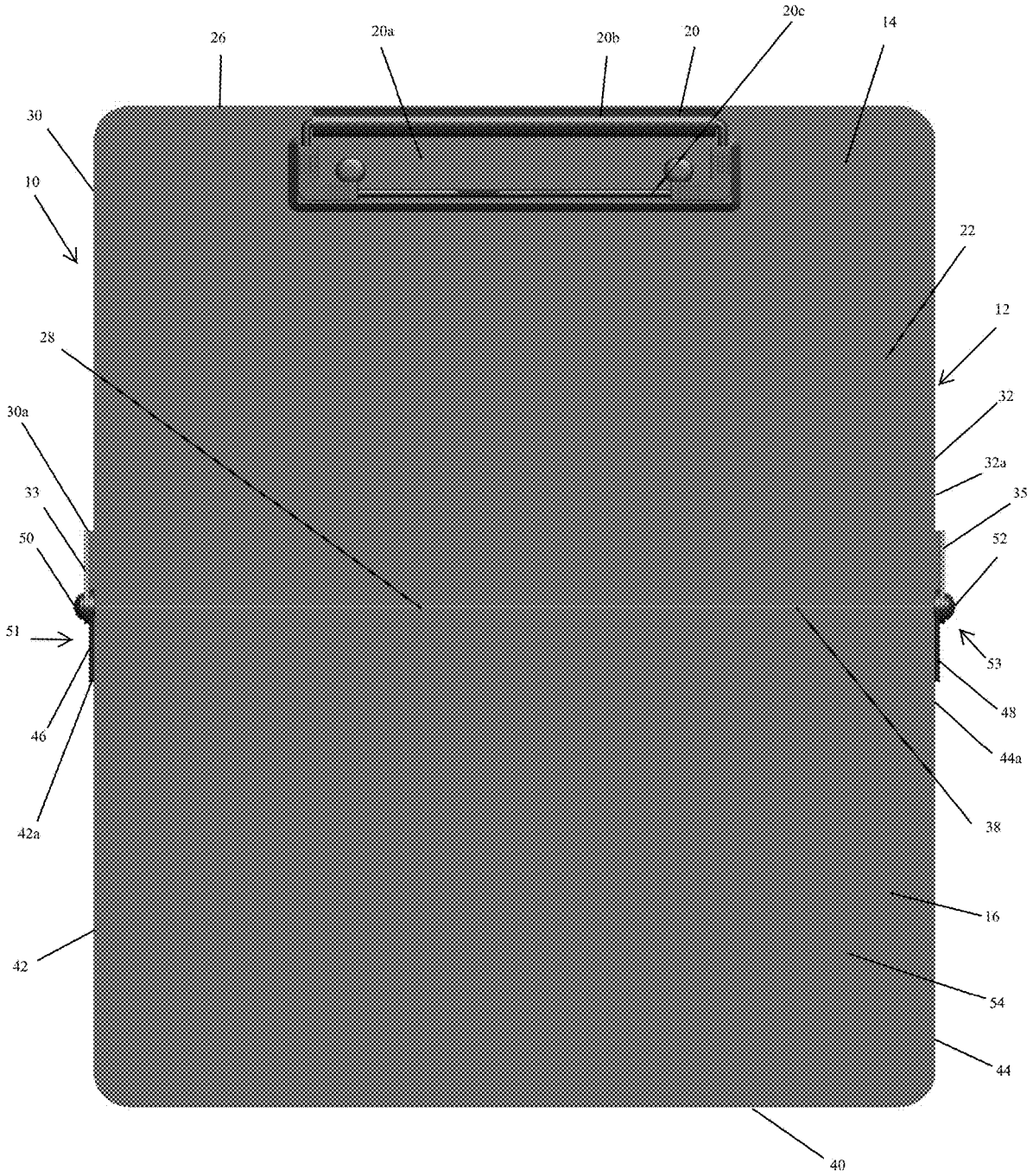
FIG. 2 is a top view of the improved foldable clipboard, in accordance with the present invention.

As seen in FIGS. 1 and 2, the improved foldable clipboard 10 formed of a top folding portion 14 and a bottom folding portion 16, that are pivotally joined with first and second hinges 51 and 53, and a clip 20 affixed to the top folding portion to secure papers and other documents. When the top folding portion 14 and the bottom folding portion 16 are in a first extended orientation, the clipboard 10 assumes the form of a flat, planar structure 12, which functions as a traditional clipboard.

Figure 5:
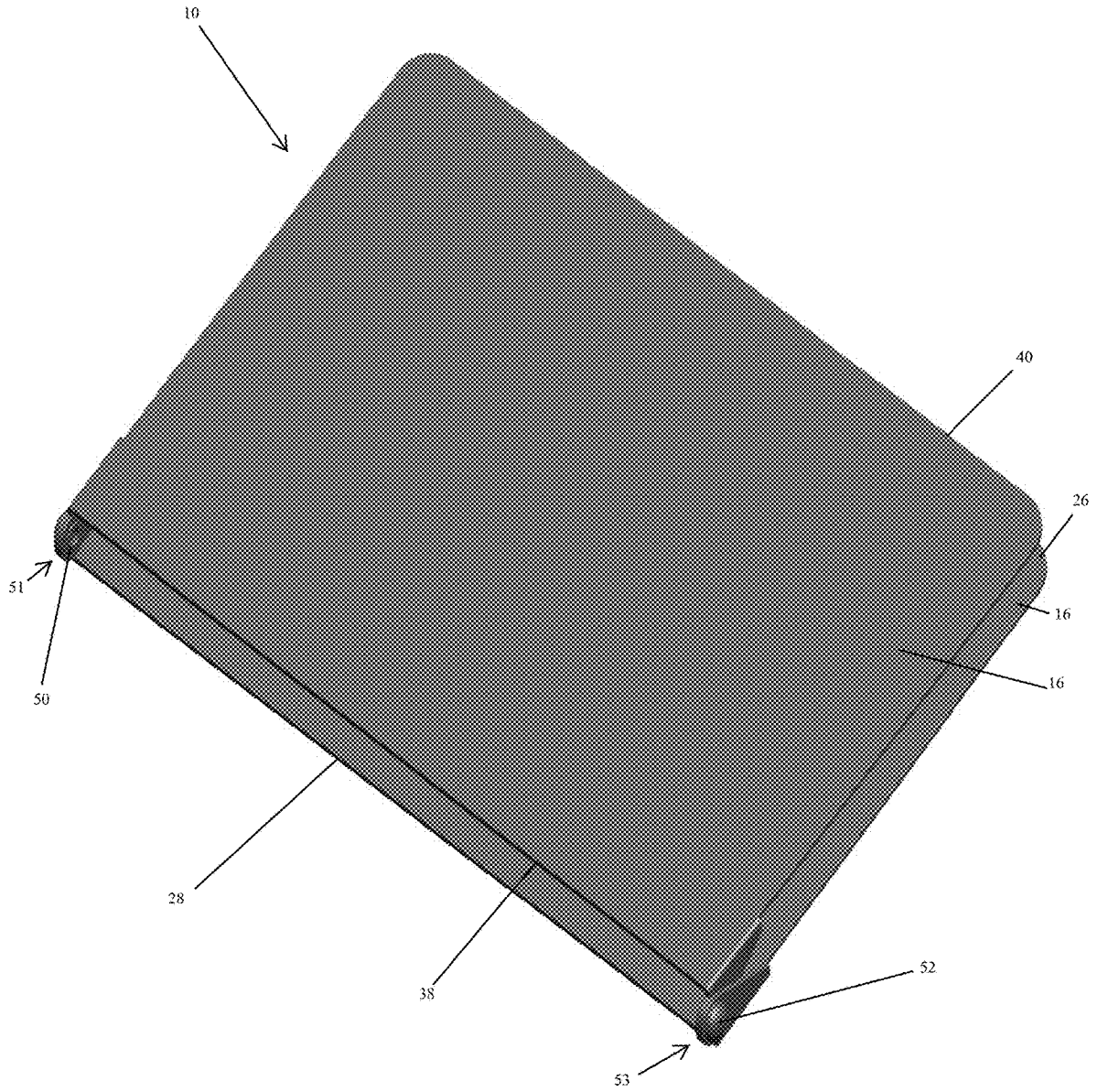
FIG. 5 is a front, three dimensional view of the improved foldable clipboard in a closed position, in accordance with the present invention.

The flat, planar structure 12 is rigid and suitable for securing documents, and providing a writing surface. When the top folding portion 14 and the bottom folding portion 16 are in a second folded orientation, as illustrated in FIG. 5, the clipboard 10 may be easily stowed for convenience. Furthermore, when in the folded orientation, the clipboard naturally hides the papers it is holding, thus helping maintain confidentiality when that is desired.

The clipboard 10 may be constructed of any suitable rigid materials, such as cardboard, aluminum or plastic. Aluminum provides a very strong, light-weight panel that is very durable. Plastic also provides a fairly strong and light-weight panel that is relatively inexpensive to manufacture. Further, the clipboard 10 may have any desired dimensions, such as a width with a range of _____ inches to _____ inches, and a height with a range of _____ inches to _____ inches when in its first extended position. However, it must be noted that it is preferable that the clipboard 10 be sized appropriately to accommodate 8.5 inch by 11 inch paper.

The top folding portion 14 is formed of a front surface 22, a rear surface 24, a top end 26, a bottom end 28, a first side wall 30, and a second side wall 32. Each of the front and rear surfaces 22 and 24, respectively, of the top folding portion 14 are flat and planar and have no ridges, undulations, or indentations.

Figure 3:
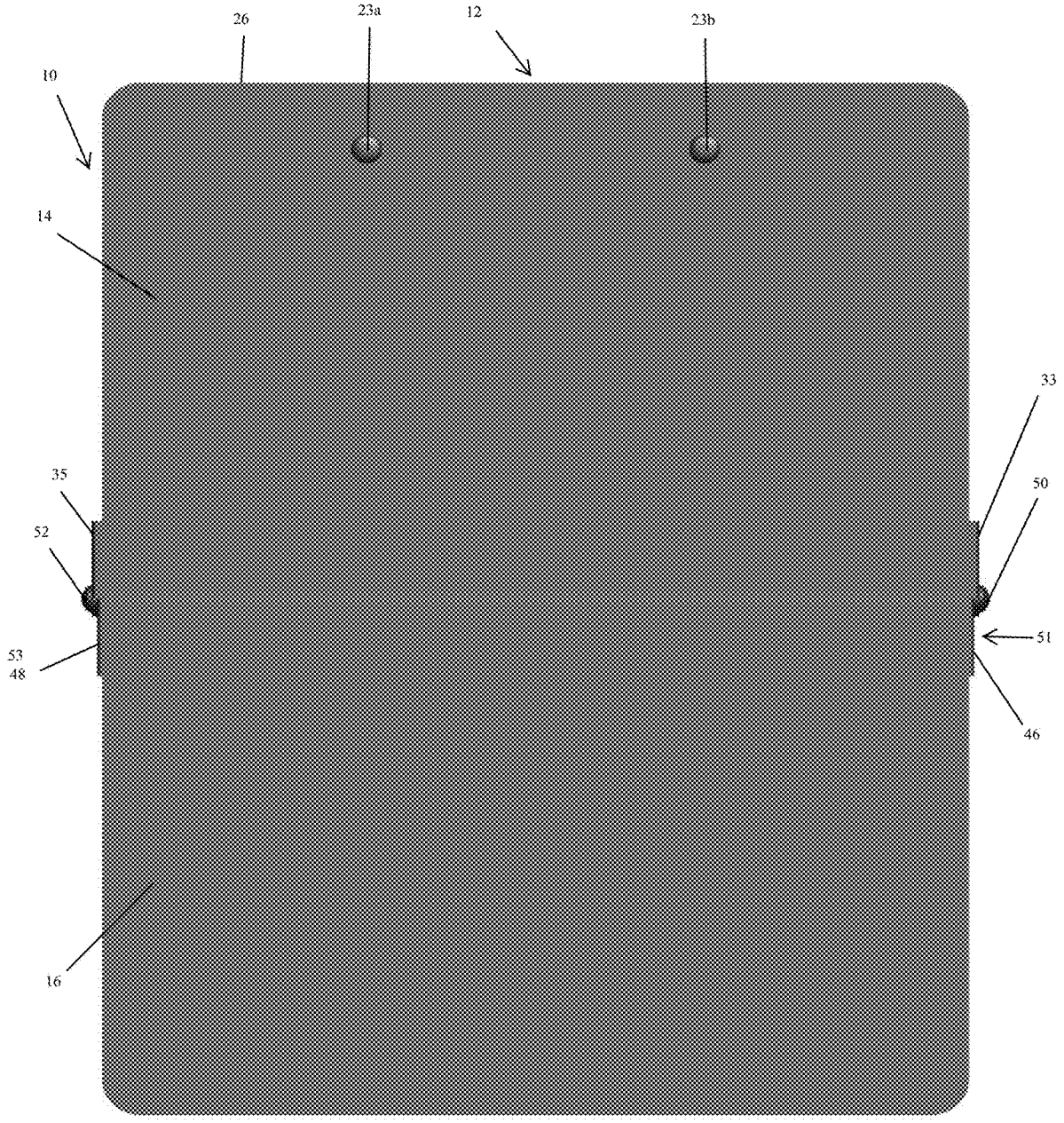
FIG. 3 is a rear view of the improved foldable clipboard, in accordance with the present invention.
Figure 4:
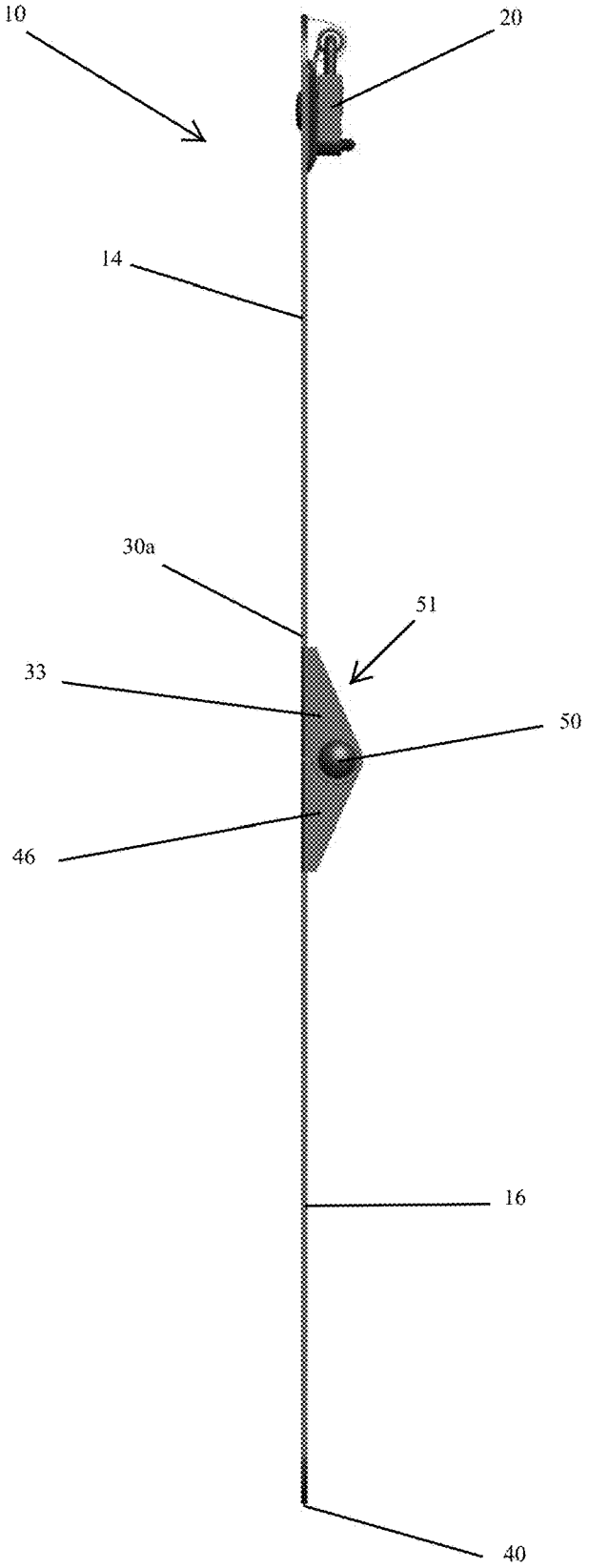
FIG. 4 is a side view of the improved foldable clipboard, in accordance with the present invention.

The clip 20 is operatively coupled to the front surface 22, generally adjacent to the top end 26. In the illustrated embodiment, the clip 20 is a spring clip sized to hold at least 25 sheets of paper to the clipboard 10. Any type of clip 20 may be utilized, such as a spring-loaded clip or a friction clip. As illustrated, a spring-loaded clip 20 is utilized, including a mounting bracket 20*a* which is attached to the top folding portion 14 with two connectors 23*a* and 23*b*, as seen in FIG. 3. A spring-loaded portion 20*b* engages a hold-down bar 20*c* which secures the documents against the clipboard 10.

Integral to the bottom portion 30*a* of the first side wall 30 is a first top hinge arm and flange or bracket 33. Similarly, integral to the bottom portion 32*a* of the second side wall 32 is a second top hinge arm and flange or bracket 35. First top hinge arm and bracket 33 and second top hinge arm and bracket 35 are identical in dimension and function, as discussed hereinafter.

The bottom folding portion 16 is formed of a front surface 34, a rear surface 36, a top end 38, a bottom end 40, a first side wall 42, and a second side wall 44. Each of the front and rear surfaces 34 and 36, respectively, of the bottom folding portion 16 are flat and planar and have no ridges, undulations, or indentations.

Integral to the top portion 42*a* of the first side wall 42 is a first bottom hinge arm 46. Similarly, integral to the top portion 44*a* of the second side wall 44 is a second bottom hinge arm 48. First bottom hinge arm 46 and second bottom hinge arm 48 are identical in dimension and function, as discussed hereinafter.

The top folding portion 14 and the bottom folding portion 16 of clipboard 10 are substantially identically shaped. Each folding portion 14 and 16 is substantially rectangular with rounded edges having a slope that is preferably approximately 30 degrees. The rounded edges are advantageous in allowing the clipboard 10 to smoothly open and close.

The first top hinge arm and bracket 33 of the top folding portion 14 is pivotally attached to the first bottom hinge 46 of the bottom folding portion 16. The hinge arm and bracket 33 and the hinge arm 46 are suitably joined with a connector 50, which may include a pin, gasket, bearing assembly, or any other suitable mechanism. The hinge arm and bracket 33 and hinge arm 46 are joined with a connector 50 form a first hinge 51.

Similarly, the second top hinge arm and bracket 35 of the top folding portion 14 is pivotally attached to the second bottom hinge 48 of the bottom folding portion 16. The hinge arm and bracket 35 and the hinge arm 48 are suitably joined with a connector 52, which may include a pin, gasket, bearing assembly, or any other suitable mechanism. The hinge arm and bracket 35 and the hinge arm 48 are joined with a connector 52 form a second hinge 53.

The first top hinge arm and bracket 33 and the first bottom hinge arm 46, and the second top hinge arm and bracket 35 and the second bottom hinge arm 48 allow the top folding portion 14 and the bottom folding portion 16 to pivot approximately 180° relative to one another. In other words, when in the flat configuration, the top folding portion 14 is pivoted 180° relative to the bottom folding portion 16, and when in the folded configuration, the top folding portion 14 is generally 0° relative the bottom folding portion 16.

In use, the clipboard 10 has two functioning orientations, as discussed hereinabove. In a first extended orientation, the clipboard 10 assumes the form of a flat, planar structure 12 which functions as a traditional clipboard. In this orientation, the top folding portion 14 and the bottom folding portion 16 are parallel to each other. To switch to the second folded orientation, as illustrated in FIG. 5, the top folding portion 14 and the bottom folding portion 16 are swiveled about each of the hinges 50 and 52 to reach a folded orientation.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An improved foldable clipboard including an extended orientation and a folded orientation, comprising;

a top folding portion including a first top hinge arm and a second top hinge arm, each first top hinge arm and second top hinge arm comprising a bracket which extends outward, away from opposing sidewalls of the top folding portion;

a bottom folding portion including a first bottom hinge arm and a second bottom hinge arm, each of the first bottom hinge arm and the second bottom arm positioned against opposing sidewalls of the bottom folding portion;

a pair of connectors, one connector of the pair of connectors connecting the first top hinge arm to the first bottom hinge arm to form a first hinge, and the other connector of the pair of connectors connecting the second top hinge arm to the second bottom hinge arm to form a second hinge, wherein an inner side of each first and second top hinge arms at least partially overlap an outer side of each first and second bottom hinge arms, respectively, when in the folded orientation, wherein the top folding portion and the bottom folding portion are moveable to form the folded orientation, such that one of the top folding portion and the bottom folded portion is overlapped but spaced apart from the other of the top folding portion and the bottom folded portion to form the folded orientation, wherein the top folding portion and the bottom folding portion extends away from each other and a portion of the top folding portion abuts a portion of the bottom folding portion to form a flat, planar structure of the extended orientation, wherein in the extended orientation, a top end of the top folding portion and the bottom end of the bottom folding portion are parallel to each other, wherein in the extended orientation, the top folding portion and the bottom folding portion are in an axially alignment and extend axially to form an axially oriented rectangle, and wherein when at least one of the top folding portion and the bottom folding portion is moved to form the folded orientation, the at least one of the top folding portion and the bottom folding portion is moved transversely relative to the axial alignment to form a smaller rectangle which has a smaller axial length relative to the extended orientation; and a clip operatively coupled to a front surface of the top folding portion, wherein the first top hinge and second top hinge and their respective brackets, and the first bottom hinge and the second bottom hinge are integrally formed with the top folding portion and the bottom folding portion, respectively.

2. The improved foldable clipboard of claim 1, wherein the clipboard is constructed from at least one of cardboard, aluminum and plastic.

3. The improved foldable clipboard of claim 2, wherein the top folding portion is formed of a front surface, a rear surface, a top end, a bottom end, a first side wall, and a second side wall.

4. The improved foldable clipboard of claim 3, wherein the bottom folding portion is formed of a front surface, a rear surface, a top end, a bottom end, a first side wall, and a second side wall.

5. The improved foldable clipboard of claim 4, wherein the hinges are one of scissor hinges or knife hinges.

6. The improved foldable clipboard of claim 5, wherein the hinges do not completely overlap when the improved folding clipboard is in the folded orientation.

7. The improved foldable clipboard of claim 1, wherein the pair of connectors comprise at least one of a pin, gasket, and bearing assembly.

8. The improved foldable clipboard of claim 1, wherein the top folding portion and the bottom folding portion pivot approximately 180° relative to one another in the extended orientation, forming a flat, planar orientation.

9. The improved foldable clipboard of claim 8, wherein the top folding portion and the bottom folding portion to pivot approximately 0° relative to one another in the folded orientation.

10. The improved foldable clipboard of claim 8, wherein the clip is spring-loaded clip and includes a mounting bracket attached to the top folding portion with two connectors.

11. The improved foldable clipboard of claim 10, wherein a spring-loaded portion of the clip engages a hold-down bar which secures at least one document against the clipboard.

* * * * *